United States Patent [19]

Brolin

[11] 4,003,475

[45] Jan. 18, 1977

[54] CRANE BOOM LATTICE AND HOIST LINE PROTECTION ASSEMBLY

[75] Inventor: Charles A. Brolin, Cedar Rapids, Iowa

[73] Assignee: FMC Corporation, San Jose, Calif.

[22] Filed: Nov. 27, 1974

[21] Appl. No.: 527,562

[52] U.S. Cl. ..... 212/144; 52/116; 52/716

[51] Int. Cl.[2] ..... B66C 23/62

[58] Field of Search ..... 212/144, 28, 40, 58–59; 52/716–718, 244, 116–118, 121

[56] References Cited

UNITED STATES PATENTS

| | | | |
|---|---|---|---|
| 1,620,933 | 3/1927 | Wilcox | 52/716 |
| 2,461,082 | 2/1949 | Purnell | 52/716 X |
| 3,290,082 | 12/1966 | Fritsch | 52/716 X |
| 3,323,660 | 6/1967 | Allin | 212/144 |
| 3,388,523 | 6/1968 | Evans | 52/717 |
| 3,430,778 | 3/1969 | Brown | 212/144 |
| 3,606,432 | 9/1971 | Honatzis | 52/716 X |
| 3,842,564 | 10/1974 | Brown | 52/716 |

FOREIGN PATENTS OR APPLICATIONS

| | | | |
|---|---|---|---|
| 539,191 | 7/1955 | Belgium | 52/717 |
| 2,048,002 | 4/1972 | Germany | 212/144 |

*Primary Examiner*—Robert J. Spar
*Assistant Examiner*—R. B. Johnson
*Attorney, Agent, or Firm*—J. F. Verhoeven; J. W. Edwards; C. E. Tripp

[57] ABSTRACT

A lifting crane has a boom of box lattice type construction, and a steel wire rope hoist line extending adjacent to the boom is alternately slackened and tensioned during a cyclical work period as to slap, pound or rub against some of the lattice members. This makes such lattice members vulnerable to damage by contact with the hoist line and subjects the hoist line to abrasive wear by contact with the lattice members. An elongate, rigid connector extends longitudinally of a lattice member vulnerable to damage by hoist line contact and defines a mounting base receiving slot therein. A strip of expendable material softer than the hoist line has a mounting base portion shaped to fit within the slot in the connector for securing the strip thereto and has an enlarged head portion that is positioned between the connector and the hoist line when the strip is secured to the connector to form a shock absorbing cushion that is non-abrasive to the hoist line.

2 Claims, 6 Drawing Figures

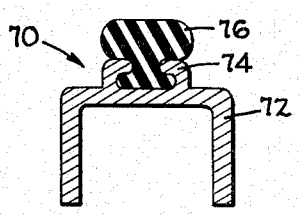
FIG_5
FIG_4
FIG_6
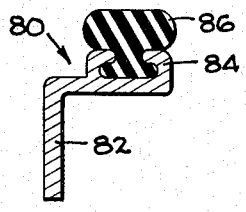
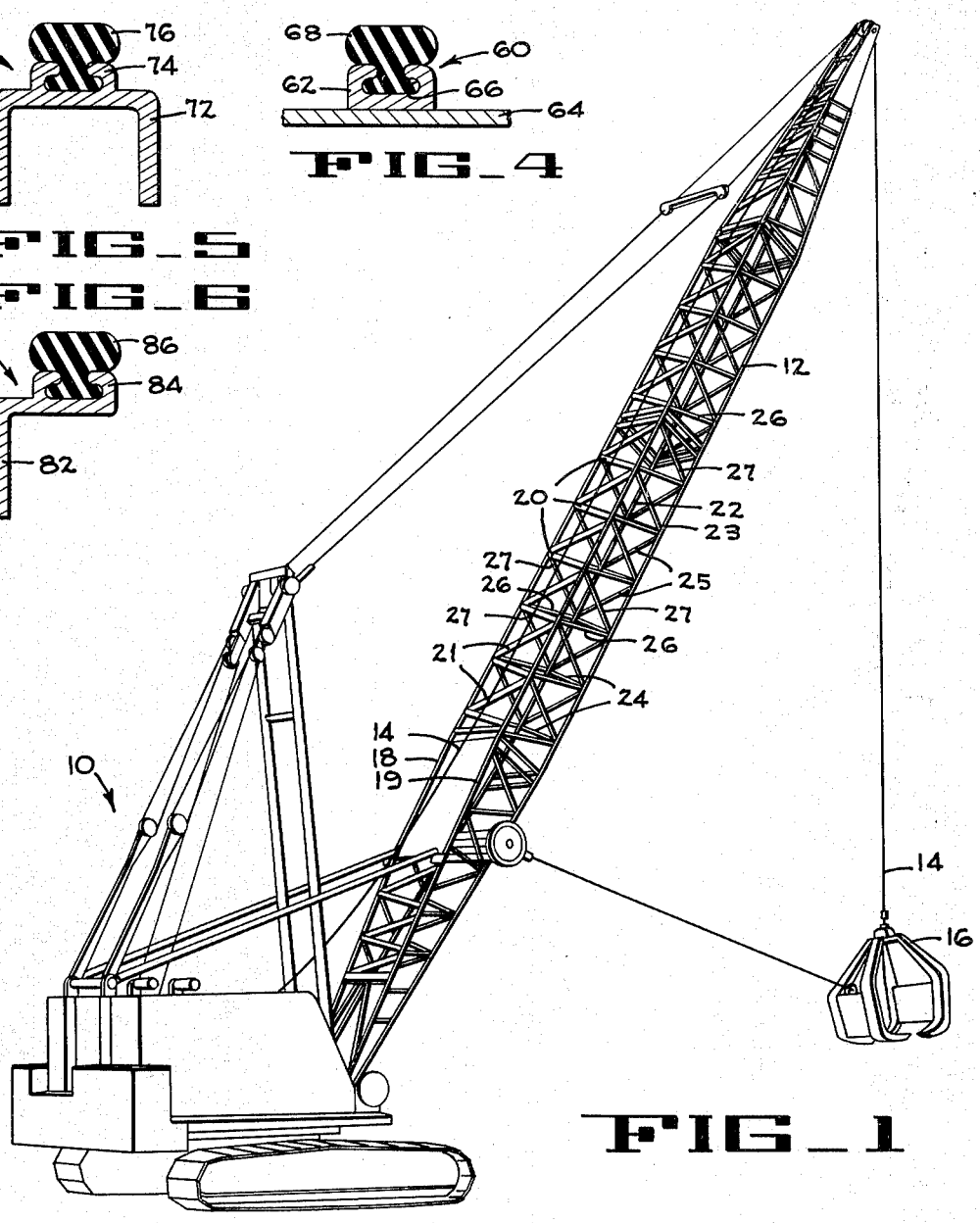
FIG_1
FIG_2
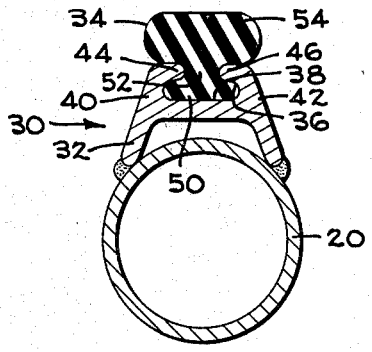
FIG_3
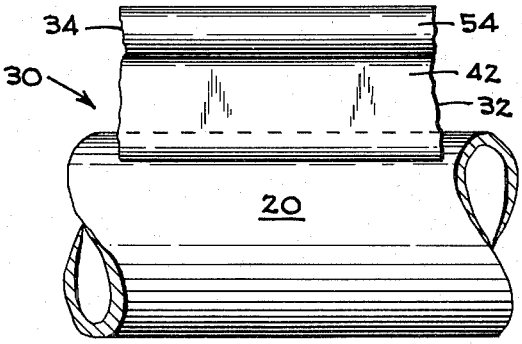

CRANE BOOM LATTICE AND HOIST LINE PROTECTION ASSEMBLY

BACKGROUND OF THE INVENTION

1. Field of the Invention

This invention relates to a device for protecting lattice members in a crane boom and for protecting a wire rope, hoist line that extends near the lattice members from damage due to impact and abrasion resulting from the hoist line pounding, slapping and rubbing against the lattice members as the hoist line is alternately slackened and tensioned.

2. Description of the Prior Art

Lifting cranes are used in a variety of applications that involve a cyclical work period of alternately slackening and tensioning a hoist line. Such applications include handling a wood yard grapple, a scrap yard magnet, a clamshell bucket, a dragline bucket, a concrete bucket, a pile driver, a pile extractor, a demolition ball and various other crane operations that involve alternately lifting and lowering. Since the hoist line is slack at times and taut at other times during the work cycle, it acts like an enormous "violin string" and possesses tremendous energy which must be dissipated. The position of the hoist line relative to the boom changes rapidly and it frequently slaps, pounds, vibrates and rubs the lattice members within the boom. This results in damage to the lattice members and to the wire rope, hoist line. Such damage, unless corrected by repair or replacement, can cause boom failures and broken hoist lines.

Many attempts have been made at solving this problem. Rollers have been attached, at spaced intervals along the boom where contact is likely to occur, to provide an anti-friction support surface for the hoist line. Such rollers are expensive and heavy. Thus, the rollers used have often been spaced too far apart along the boom and have had a short transverse span so that complete protection was not provided. To supplement the rollers, heavy timbers have been added to the boom members to provide a wearing surface.

Due to the cost, weight and service life of protection systems utilizing rollers and timbers that have been installed by crane manufacturers, replacement after wear out is often neglected because such systems are considered to be unsatisfactory. In an attempt to solve the problem, field maintenance personnel have tied old tires or other material to the crane boom at likely points of wear. While such field systems provide about the same protection as those installed by crane manufacturers, they eventually create hazards to operating personnel due to the material coming loose and falling from the boom. Then, the field system is frequently abandoned and the exposed boom members are subjected to hoist line contact.

SUMMARY OF THE INVENTION

An elongate rigid connector extends longitudinally of a crane boom lattice member vulnerable to damage by steel, wire rope, hoist line contact and defines a mounting base receiving slot within the connector. A strip of expendable material, softer than the hoist line, has a mounting base portion shaped to fit within the slot in the connector for securing the strip thereto and has an enlarged head portion that is positioned between the connector and the hoist line when the strip is secured to the connector to form a shock absorbing cushion that is nonabrasive to the hoist line.

Such protection for a crane boom lattice member and for a wire rope, hoist line can be applied to all lattice members vulnerable to damage by the hoist line and can extend along the full length of the lattice members to provide total coverage. After the connector has been attached to the lattice member, the strip of expendable material can be readily replaced within the connector but wear on the enlarged head portion of the strip does not weaken the connection between the mounting base portion and the slot within the connector. The expendable material is selected to form a shock absorbing cushion that is non-abrasive to the hoist line.

BRIEF DESCRIPTION OF THE DRAWING

FIG. 1 is a perspective view of a lifting crane in which the present invention is embodied.

FIG. 2 is a transverse section of a lattice member with the crane boom lattice and hoist line protection assembly mounted thereon.

FIG. 3 is a side elevation view of the assembly shown in FIG. 2.

FIG. 4 is a transverse section illustrating a modified form of the invention.

FIG. 5 is a transverse section illustrating another modified form of the invention.

FIG. 6 is a transverse section illustrating a further modified form of the invention.

DESCRIPTION OF THE PREFERRED EMBODIMENT

With reference of FIG. 1, a lifting crane 10 has a boom 12 and a hoist line 14 that extends over the boom to the outermost end thereof where the hoist line is suspended for attachment to a grapple 16. The boom is formed by structural members in a box lattice type of construction. The top panel of the boom is formed by longitudinal chord members 18 and 19 and a series of lattice members 20 and 21 that extend laterally and diagonally therebetween, respectively. Similarly, the bottom panel of the boom is formed by longitudinal chord members 22 and 23 and a series of lattice members 24 and 25 that extend laterally and diagonally therebetween, respectively. The top panel is spaced from the bottom panel by a series of lattice members 26 and 27.

As the hoist line 14 is alternately tensioned to elevate the grapple 16 and slackened to drop the grapple, the hoist line tends to slap, pound, vibrate and rub against the lattice members 20 and 21 located in the top chord along the outer portion of the boom 12. Such lattice members are thus vulnerable to damage by contact with the hoist line and the hoist line is subject to abrasive wear by contact with the lattice members. To reduce such damage and prevent such wear, a crane boom lattice and hoist line protection assembly 30, as shown in FIGS. 2 and 3, is mounted upon the vulnerable lattice members.

The assembly 30 includes an elongate, rigid connector 32 that extends longitudinally of a lattice member 20 and a strip 34 of expendable material that is replaceably secured to the connector to provide a shock absorbing cushion that is non-abrasive to the hoist line 14. Since lattice member 20 has a round tubular shape, the connector 32 is shaped to accommodate mounting thereon and it will be understood that if the lattice member had an angular shape, the connector portion mounted thereto would be adapted accordingly. Normally, the connector is permanently attached to the lattice member by fusion welding, but can be attached by other means such as bolting, adhesive bonding, riveting, brazing, soldering, etc. The connector strengthens the lattice member, extending longitudinally thereof, and is oriented thereon to project upward vertically from the lattice member when the boom 12 extends horizontally.

When the connector 32 is attached to a lattice member 20, a slot 36 is defined in the upper portion of the connector by a support surface 38 and a pair of flanges 40 and 42. The support surface 38 defines the back of the slot, while the sides of the slot are defined by the flanges that extend outward from the support surface. At the outer ends of flanges 40 and 42 are portions 44 and 46, respectively, that project in opposed relationship to each other over part of the support surface, at a distance spaced outwardly therefrom, to define the front of the slot together with an opening left between the opposed flange portions. The slot is adapted to receive a mounting base portion 50 of the expendable material strip 34 for replaceable attachment to the connector without additional clamps, bolts or bonding adhesives.

The strip 34 has a web portion 52 that extends between the opposed flange portions 44 and 46 to connect the mounting base portion 50 with an enlarged head portion 54. This head portion is wide enough to cover the connector 32 and has a thickness sufficient to provide a good shock absorbing cushion. The strip is preferably made of resilient rubber or rubberlike material but can also be made from plastics such as polyurethane, polypropolene, or nylon. The strip must be an expendable material, softer than the steel, wire rope, hoist line 14 to be non-abrasive thereto, and it must also be able to absorb the impact of the hoist line pounding thereon and transmit the resultant force at a reduced level to the connector. The strip can be an elastomeric material that is stretched to insert the mounting base portion into the slot 36 of the connector and then expands to grip the connector when the stretching force is released.

It should be noted that when a blow is directed downward upon the head portion 54 of the expendable material strip 34, the mounting base portion 50 tends to compress against the mounting base support surface 38 and expand laterally against the flanges 40 and 42 to cause a tighter gripping contact with the connector 32. Similarly, the web portion 52 expands laterally against the opposed flange portions 44 and 46 to cause a tighter gripping contact. Thus, a blow directed downward upon the head portion of the expendable material strip causes a tighter grip between the strip and the connector and helps keep the strip in its proper location for receiving the next blow.

The crane boom lattice and hoist line protection assembly 30 can be installed at a factory by the crane manufacturer or can be installed in the field by maintenance personnel. Once the connector 32 has been mounted upon a lattice member such as 20 or 21, the expendable material strip 34 can be readily removed and replaced by simply sliding one strip out of the slot 36 and pulling another strip therein. Thus, maintenance can be performed quickly and at a reasonable cost.

A modified form of protection assembly 60 is shown in FIG. 4. A connector 62 is mounted directly upon a flat plate, bar or horizontal flange of a structural shape that forms a lattice member 64. The connector has a slot 66 therein, similar to the previously described slot 36, for retaining a strip 68 of expendable material.

Another modified form of protection assembly 70 is shown in FIG. 5. In this form, a lattice member 72 has a channel shape and a connector 74 is formed integral therewith for retaining a strip 76 of expendable material. A further modified form of protection assembly 80, shown in FIG. 6, has a lattice member 82 with an angular shape and a connector 84 is formed integral with the lattice member for retaining a strip 86 of expendable material.

The crane boom lattice and hoist line protection assemblies disclosed herein are light in weight and thus, can be applied to all lattice members vulnerable to hoist line damage without materially reducing the lifting capacity of the crane. The assemblies are economical to install and maintain. Since there is no hardware likely to come loose and fall, a safer operation is achieved. The assemblies can be applied to all makes and models of cranes and the strip of expendable material can be uniform to fit all assemblies.

Although the best mode contemplated for carrying out the present invention has been herein shown and described, it will be understood that modification and variation may be made without departing from what is regarded to be the subject matter of the invention.
JWE:csa

What is claimed is:

1. In a crane having a boom, a hoist line extending along said boom thereadjacent, said boom including spaced transverse elongate lattice members vulnerable to damage by impacting movement of the hoist line thereagainst, the improvement therein comprising a lattice and hoist line protection assembly mounted upon each said vulnerable lattice member, said protection assembly including an elongate rigid connector disposed parallel to each said lattice member and extending longitudinally thereof, said rigid connector having a bottom wall, spaced side walls extending from said bottom wall and defining a longitudinal receiving slot, spaced legs depending from said bottom wall along the length thereof, means connecting said legs to said lattice member, thereby reinforcing said lattice member against bending forces, and, a strip of expendable cushioning material slidably received in said slot, said strip including a head portion, a mounting base portion retainably received within and substantially filling said slot to be contiguous with said bottom wall of said rigid connector and connected through said slot to said head portion, said head portion being positioned between said connector and said hoist line, said head portion having a width greater than said slot and at least as great as said bottom wall thereby to form a replaceable shock-absorbing cushion to receive wear from said hoist line.

2. A crane boom lattice and hoist line protection assembly as described in claim 1 wherein said elongate rigid connector and said expendable material strip extend the full length of the lattice member.

* * * * *